US006645055B1

(12) United States Patent
Olsen

(10) Patent No.: US 6,645,055 B1
(45) Date of Patent: Nov. 11, 2003

(54) APPARATUS, IN PARTICULAR FOR THE GRINDING OF ELECTRODES FOR TIG WELDING

(76) Inventor: Heine Plougman Olsen, Engblommevej 2, DK-9230 Svenstrup (DK)

( * ) Notice: Subject to any disclaimer, the term of this patent is extended or adjusted under 35 U.S.C. 154(b) by 0 days.

(21) Appl. No.: 09/830,450

(22) PCT Filed: Oct. 27, 1999

(86) PCT No.: PCT/DK99/00585

§ 371 (c)(1),
(2), (4) Date: Oct. 4, 2001

(87) PCT Pub. No.: WO00/27588

PCT Pub. Date: May 18, 2000

(30) Foreign Application Priority Data

Oct. 27, 1998 (DK) ..... 1998 01383

(51) Int. Cl.[7] ..... B24B 9/00
(52) U.S. Cl. ..... 451/259; 451/282; 451/49
(58) Field of Search ..... 451/49, 282, 283, 451/241, 242, 244, 259, 111, 210

(56) References Cited

U.S. PATENT DOCUMENTS

| | | | | | |
|---|---|---|---|---|---|
| 584,114 | A | * | 6/1897 | Hill | 451/276 |
| 2,344,420 | A | * | 3/1944 | Schwartz | 451/375 |
| 3,852,921 | A | * | 12/1974 | Craig et al. | 451/291 |
| 3,924,359 | A | | 12/1975 | Schaller | |
| 4,142,332 | A | * | 3/1979 | Clarke | 451/278 |
| 4,547,999 | A | * | 10/1985 | Reiling et al. | 451/375 |
| 5,001,868 | A | * | 3/1991 | Jankus et al. | 451/285 |
| 5,129,122 | A | * | 7/1992 | Shafer et al. | 15/88 |
| 5,259,146 | A | * | 11/1993 | Jinkins | 451/49 |
| 6,186,876 | B1 | * | 2/2001 | Christiansen | 451/278 |
| 6,244,938 | B1 | * | 6/2001 | Ploeger | 451/65 |
| 6,331,133 | B1 | * | 12/2001 | Katayama et al. | 451/9 |

FOREIGN PATENT DOCUMENTS

| | | |
|---|---|---|
| DE | 886011 | 2/1953 |
| DE | 3305149 | 6/1984 |
| DE | 4330495 | 3/1995 |
| EP | 0385069 | 5/1990 |
| FR | 2747332 | 10/1997 |
| SU | 287539 | * 11/1970 |
| SU | 663554 | * 5/1979 |

OTHER PUBLICATIONS

Derwent Abstract, No. B3339 C/06, week 8006 of SU 663554 entitled "Universal Machine . . . Spring Half–Shaft" of Tochmash Precision.

* cited by examiner

*Primary Examiner*—Lee D. Wilson
(74) *Attorney, Agent, or Firm*—Dykema Gossett PLLC

(57) ABSTRACT

A grinding apparatus for pointing electrodes for TIG welding including a rotatable grinding disc, a holding device for the electrode, and a feeding device for feeding the electrode toward the grinding disc, the holding device and the grinding disc being adjustable so that a longitudinal direction of the electrode forms a desired angle with the plane of the grinding disc. The feed device includes a drive roller which is adapted to press the electrode laterally toward the grinding disc and an axis of the rotation of the roller forms an angle with the longitudinal axis of the electrode so that the roller by rotation moves the electrode forwards towards the grinding disc.

7 Claims, 3 Drawing Sheets

APPARATUS, IN PARTICULAR FOR THE GRINDING OF ELECTRODES FOR TIG WELDING

BACKGROUND OF THE INVENTION

1 . Field of the Invention

The invention relates to a grinding apparatus for pointing electrodes for TIG welding, the apparatus including a rotatable grinding disc and a holding device for the electrode as well as a feed device for feeding the electrode toward the grinding disc, wherein the holding device and the grinding disc are adapted to be adjusted relative to each other so that the longitudinal direction of the electrode forms a desired angle with the plane of the grinding disc.

2. The Prior Art

In TIG welding it is important to keep the electrode pointed to achieve a good an stable arc. This is decisive for the achievement of a good weld. However, the tip is worn by the arc itself, just as particles may splash from the molten pool onto the electrode, and it also happens that the electrode can be accidentally dipped down into the molten pool, in particular when the operator is welding in an awkward position.

Special grinding machines have been developed for the grinding of the electrodes, which are typically of wolf-ram. These machines, however, are cumbersome in use, which means that the electrodes are not maintained to the necessary extent, resulting in welds of inferior quality. For example, in one of the known machines the electrodes have to be mounted in a special holder, and there are several different holders adapted to electrode diameters. The holder with the electrode then has to be mounted in the machine.

DE 33 05 149 describes a grinding machine which may be used for the grinding of wolfram electrodes, which are secured in a holder that is moved with threaded spindles until the electrode tip makes contact with the grinding disc. As the spindles have to be screwed both forwards and backwards for each electrode to be pointed, the grinding machine is very slow in use.

The object of the invention is to provide a grinding apparatus which is simple in use, and which is simultaneously faster to load and unload.

SUMMARY OF THE INVENTION

This is achieved by an apparatus according to the invention, wherein the feed device includes a drivable roller which is adapted to press the electrode laterally toward the grinding disc, and wherein the axis of rotation of the roller forms an angle with the longitudinal axis of the electrode, so that the roller by rotation moves the electrode forwards toward the grinding disc.

The apparatus is simple in use, as, in the insertion position, the electrode is merely to be placed on the carrier face of the first element, following which the two elements are mutually displaced to secure the electrode. After pointing, the electrode is released merely by returning the carrier face of the first element to the insertion position. Guide faces facilitating the positioning of the electrode may be provided in connection with the carrier face on the first element. Securing of the electrode may involve fixing, where the two elements as a unit with the fixed electrode are fed toward the grinding disc in the desired angular position. Also loose securing may be involved, said electrode being axially movable so that it may be moved toward the grinding disc.

The roller may rotate about a first centre of rotation, said roller having a shaft which is moved in the cylinder of an enclosing guide. This ensures stable rotation of the roller.

The carrier face for the electrode may advantageously be formed by a longitudinal plate member which is mounted rotatably about the first centre of rotation, said plate member having an edge in its longitudinal direction for carrying the electrode during insertion and loading of the grinding apparatus. This ensures simple insertion of the electrode.

The roller may be made of preferably an elastomeric material which is adapted to press the electrode laterally toward the grinding disc, and the axis of rotation of the roller may form such an angle with the longitudinal axis of the electrode that the roller by rotation moves the electrode toward the grinding disc. It has been found that the roller just has to be inclined slightly for it to carry the electrode forwards toward the side of the grinding disc.

The grinding apparatus may contain a plate member with a carrier face which cooperates with a rear member with a longitudinal downwardly facing engagement face for securing the electrode in a lateral direction in a grinding position. This ensures effective securing of the electrode in the grinding position.

The grinding apparatus may be formed with an edge on the plate member which cooperates with a first notch for securing the electrode in the grinding position, said first notch being formed in a side plate, said side plate likewise having a second notch for locking the plate member in an operative position. The grinding apparatus may hereby be locked in the grinding position, so that the operator just has to ensure rotation of the electrode during grinding.

The grinding apparatus may contain a guide cylinder which is swingably mounted on the plate member and spring-loaded to engage it. During grinding, the electrode may hereby automatically be pushed against the roller which pushes the electrode against the grinding disc.

The grinding apparatus may be constructed so that the rear edge of the plate member serves as a stop for rotation of the cylinder member in cooperation with a fixed part in the apparatus. The movement of an insertion handle may hereby be limited, thereby optimizing the operation of the grinding apparatus.

A possible embodiment of the apparatus according to the invention will be described more fully with reference to the accompanying drawings.

DETAILED DESCRIPTION OF THE PREFERRED EMBODIMENT

Figure 2:
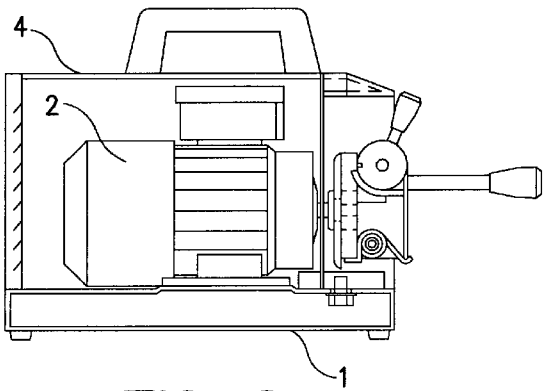
FIG. 2 shows the apparatus seen from the side in a longitudinal section.
Figure 1:
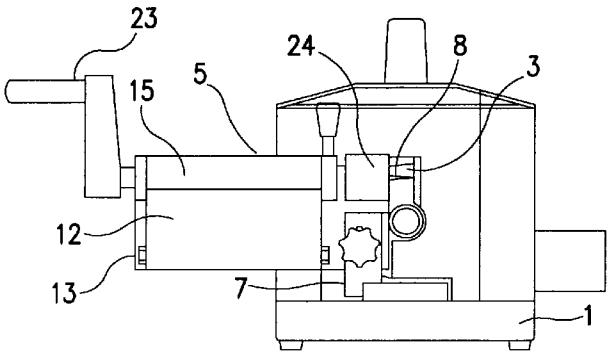
FIG. 1 shows the apparatus seen directly from the front.
Figure 3:
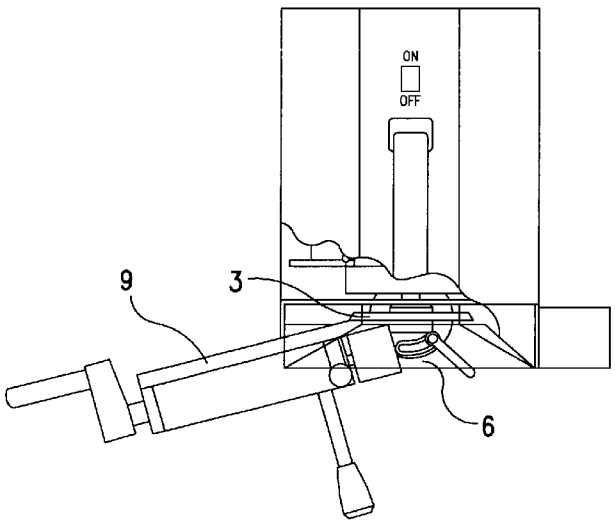
FIG. 3 shows the apparatus seen directly from above.

As will appear from FIGS. 1–3, the apparatus includes a base 1 equipped with rubber legs. An electric motor 2 is mounted on the base, and a mounting device for a diamond grinding disc 3 is provided on the shaft of the electric motor. The motor with its electrical equipment is encapsulated in a cabinet 4 with a carrier handle. The front end of the apparatus mounts an assembly 5 on an angle adjustment device by means of which the angle of the apparatus relative to the grinding disc may be adjusted. Furthermore, the assembly 5 is height-adjustable in a bracket 7. The assembly 5 is constructed partly as a holding device for an electrode 8 partly as a feed device for feeding the electrode toward the grinding disc.

Figure 5:
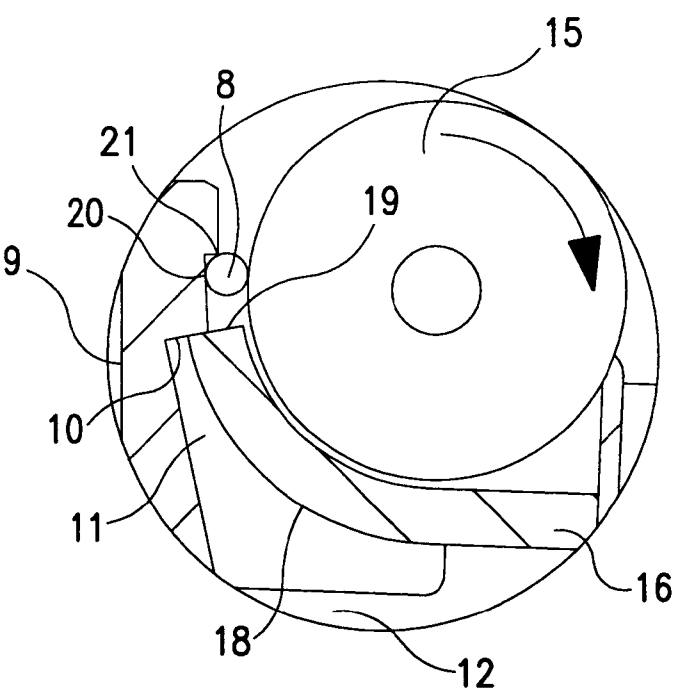
FIG. 5 is a fragmentary view of the holding device with an inserted electrode.
Figure 4:
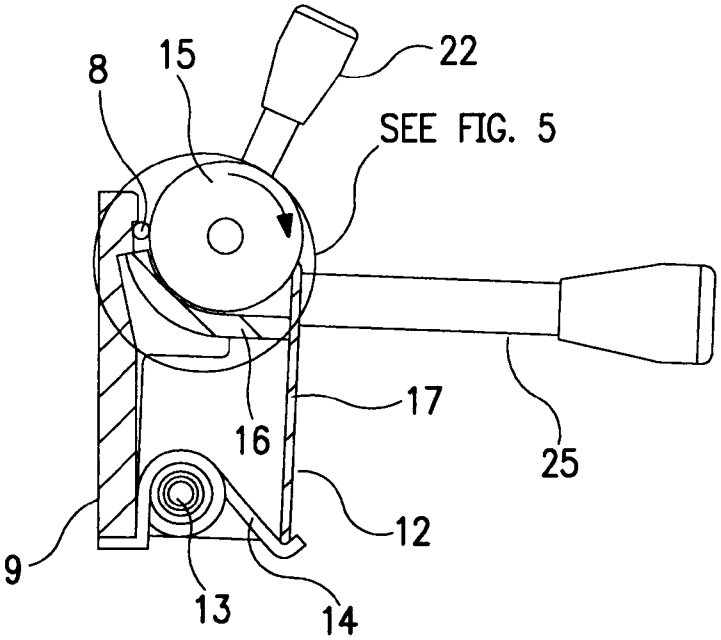
FIG. 4 shows a holding device seen directly from the front.
Figure 6:
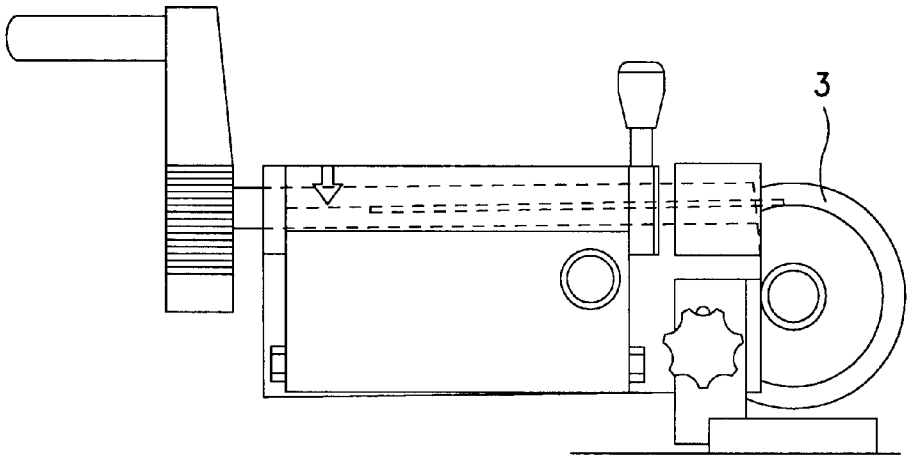
FIG. 6 is a view corresponding to FIG. 1, but indicating an electrode inserted into the apparatus.

With reference to FIGS. 4 and 5, the assembly includes a rear member 9 formed with a downwardly facing edge 10 in a longitudinal notch 11. The rear member 9 as a whole is mounted on the height adjustment device, which is in turn mounted on the angle adjustment device. As will appear from FIG. 3, the front end of the rear member toward the grinding disc is inclined to support the electrode as close to the grinding disc as possible. A housing 12 is rotatably mounted about a longitudinal shaft 13 on the front side of the rear member. The housing is spring-loaded by a spring 14 to engage the rear member. A cylinder member 15 is provided at the top of the housing, and below the cylinder member a plate member 16 extends from the front side 17 in the housing inwardly toward the rear member and curves somewhat upwards along the cylinder member 15. The curvature 18 of the plate member ends in an upwardly facing edge 19. This edge 19 cooperates with the downwardly facing edge 10 in the notch 11.

Above the notch 11 there is an additional notch 20 with a downwardly facing face 21 intended to secure an electrode 8. The cylinder member 15, to which the plate member 16 is secured, is mounted rotatably about its longitudinal axis at each end of the housing 12. The cylinder member is provided with a handle 22 for rotation of it.

Figure 7:
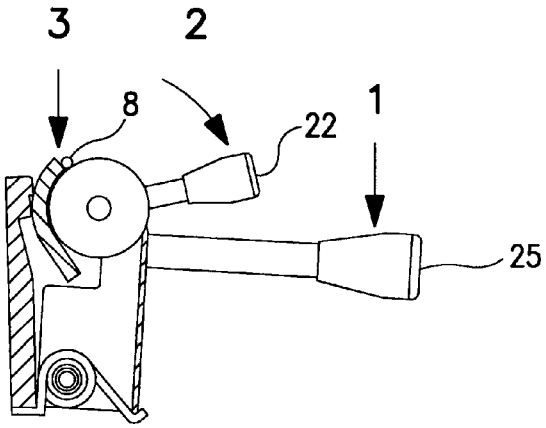
FIG. 7 shows the holding device seen from the front during movement to the insertion position.
Figure 8:
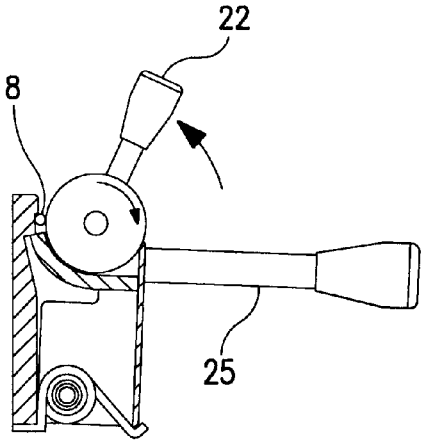
FIG. 8 shows the holding device during movement to the securing position with an inserted electrode.

Insertion of an electrode into the apparatus takes place as illustrated in FIGS. 7 and 8. As will appear from FIG. 7, the functional handle 25 is pressed down, and the handle 22 is pulled out, thereby causing the housing with cylinder member as a whole to rotate about the shaft 13 against the spring force, i.e., away from the rear member 9. The plate member 16 hereby disengages the notch 11 in the rear member. Rotation of the handle 22 causes the cylinder member to be rotated to an insertion position in which the edge 19 on the plate member faces upwards and, together with the cylinder member, forms an angular groove into which the electrode 8 may be placed. The cylinder member is then rotated back, as shown in FIG. 8, the electrode 8 being carried on the edge 19 and being moved down between the cylinder member and the rear member 9. The edge 19 extends further down and engages the notch 11 in the rear member. The electrode will become seated between the part of the edge 19 protruding from the rear member and the notch 20 with the downwardly facing edge 21.

The cylinder member 15 is formed with a longitudinal bore for a shaft which is provided with a crank 23 on the rear end, while a propulsion roller 24 of elastomeric material is mounted on the front end of the shaft. This roller will press the electrode inwards toward the rear member while pushing the electrode forwards toward the side of the grinding disc 3. This is caused by the fact that the propulsion roller is positioned slightly inclined relative to the electrode and the groove in which it is positioned. It has been found that just a quite small angle is sufficient between the propulsion roller and the electrode to cause the latter to be pushed forwards when the roller is rotated by the handle. The rotation of the propulsion roller and the rotation of the grinding disc cause the electrode to be firmly seated in the notch 20.

The pointing angle on the electrode is adjusted by the angle adjustment device, and in order to utilize the greatest possible part of the diamond grinding disc the entire assembly with insertion and propulsion may be moved up and down, i.e. when the diamond disc is worn in an annular groove, the assembly as a whole may be raised or lowered to utilize another part of the grinding disc.

When the electrode has been ground, it may be removed from the apparatus by performing the same operations as shown in FIGS. 7 and 8.

The apparatus is shown here in a manual design, but it will be appreciated that it may be made fully automatic, with the propulsion roller likewise being driven by an electric motor.

In particular grinding of wolfram electrodes for TIG welding has been described here, but it is evident that the apparatus may be used for pointing of other wire-shaped objects.

Reference Numerals

| | |
|---|---|
| 1. | Base |
| 2. | Electric motor |
| 3. | Diamond grinding disc |
| 4. | Cabinet |
| 5. | Assembly |
| 6. | Angle adjustment device |
| 7. | Height adjustment device |
| 8. | Electrode |
| 9. | Rear member |
| 10. | Downwardly facing edge |
| 11. | Notch |
| 12. | Housing |
| 13. | Shaft |
| 14. | Spring |
| 15. | Cylinder member |
| 16. | Plate member |
| 17. | Front side |
| 18. | Curvature |
| 19. | Upwardly facing edge |
| 20. | Notch |
| 21. | Downwardly facing face |
| 22. | Handle |
| 23. | Crank |
| 24. | Propulsion roller |
| 25. | Functional handle |

What is claimed is:

1. A grinding apparatus for pointing electrodes for TIG welding and comprising a rotatable grinding disc and a holding device for the electrode, as well as a feed device for feeding the electrode toward the grinding disc, wherein the holding device and the grinding disc are adapted to be adjusted relative to each other so that a longitudinal direction of the electrode forms a desired angle with a plane of the grinding disc, wherein the feed device comprises a drivable roller which is adapted to press the electrode laterally toward the grinding disc, and an axis of the rotation of the roller forms an angle with the longitudinal axis of the electrode, so that the roller by rotation moves the electrode forwards toward the grinding disc, and a carrier face for the electrode is formed by a longitudinal plate member which is mounted rotatable about a first center of rotation, said plate member having an edge in its longitudinal direction for carrying the electrode during insertion and loading of the grinding apparatus.

2. A grinding apparatus according to claim 1, wherein the roller rotates about a first centre of rotation, said roller having a shaft which is moved in a cylinder of an enclosing guide.

3. A grinding apparatus according to claim 1, wherein a rotating surface of the roller is formed of an elastomeric material.

4. A grinding apparatus according to claim 1, wherein a carrier face of the plate member cooperates with a rear member with a longitudinal downwardly facing engagement face for securing the electrode in a lateral direction in a grinding position.

5. A grinding apparatus according to claim 1, wherein the edge on the plate member cooperates with a first notch for securing the electrode in the grinding position, said first notch being formed in a side plate likewise having a second notch for locking the plate member in an operative position.

6. A grinding apparatus according to claim 2, wherein the guide cylinder is pivotally mounted on the plate member and spring-loaded to engage it.

7. A grinding apparatus according to claim 6, wherein a rear edge of the plate member serves a stop for rotation of the cylinder member in cooperation with a fixed part in the apparatus.

* * * * *